United States Patent [19]

Yonkers et al.

[11] 4,185,932

[45] Jan. 29, 1980

[54] FABRIC CLEANER

[75] Inventors: Robert A. Yonkers, Grandville; Leonard A. Mattano, Grand Rapids, both of Mich.

[73] Assignee: Bissell, Inc., Grand Rapids, Mich.

[21] Appl. No.: 860,383

[22] Filed: Dec. 14, 1977

[51] Int. Cl.[2] ..... H46B 5/02

[52] U.S. Cl. ..... 401/21; 401/190; 401/208; 15/244 C

[58] Field of Search ..... 401/218, 21, 23, 24, 401/25, 208, 190; 15/244 C

[56] References Cited

U.S. PATENT DOCUMENTS

| | | | |
|---|---|---|---|
| 2,319,873 | 5/1943 | Linz | 15/244 C |
| 2,975,462 | 3/1961 | Yonkers et al. | 401/21 |
| 3,028,868 | 4/1962 | Tandler | 401/190 |
| 3,104,413 | 9/1963 | Nelson | 401/21 |
| 3,196,479 | 7/1965 | Romoser | 401/190 X |
| 3,278,974 | 10/1966 | Nighswander | 401/21 |
| 3,328,829 | 7/1967 | Nighswander | 401/21 |

*Primary Examiner*—Edward M. Coven

*Attorney, Agent, or Firm*—Andrus, Sceales, Starke & Sawall

[57] ABSTRACT

An aerosol cartridge is used to supply foam detergent directly to a polyurethane open cell sponge roller having discrete spaced radial cavities open to the outside for receiving the foam and transfer the same to the fabric of upholstery and the like. The cavities constitute working chambers which tend to be compressed as the lands between the same flex and compress in pressure contact with the fabric upon rolling thereover to thereby force the foam through the fabric, and which then suck the foam back through the fabric as the chambers expand on the back side of the roller. The cavities may be in the form of cylindrical holes burned into the sponge whereby the pores at the inner surfaces of the holes are generally closed by a skin effect.

2 Claims, 5 Drawing Figures

FABRIC CLEANER

PRIOR ART OF INTEREST

U.S. Pat. Nos. 2,538,241, Guimond, Jan. 16, 1951; 2,652,774, Sprung, Sept. 22, 1953; 2,975,462, Yonkers et al, Mar. 21, 1961; 3,184,781, Hoxie, May 25, 1965; 3,328,829, Nighswander, July 4, 1967; and 3,448,479, Cademartori, June 10, 1969.

BACKGROUND OF THE INVENTION

1. Field of the Invention

The invention relates to a fabric cleaner for upholstery and the like and which is generally employed in the application of foaming detergents to fabrics and to a novel method of applying such detergents to fabrics.

2. Description of the Prior Art

It is known in the Yonkers et al U.S. Pat. No. 2,975,462 to employ a cylindrical synthetic sponge roller for applying a foaming detergent to rugs and carpets for cleaning the same. Generally, a liquid detergent is supplied to the top of the roller and the working of the sponge roller in pressure contact with the nap generates a foam and distributes it into the nap.

It is also known in the Hoxie U.S. Pat. No. 3,184,781 to clean upholstery fabric with a sponge block surrounded by brush bristles, by applying a semi-foam detergent to the top of the block from an aerosol can, and wherein a substantial working of the sponge in pressure contact with the fabric is required to generate and transfer the foam detergent to the fabric surface.

In this latter disclosure foam is not readily transmitted through the pores of the block and it is necessary to employ a specific type of semi-foaming material in order that liquid enters the block and forms the basis for further foam generation within the interstices of the foam.

Applicators of both types when translated manually over the surface to be cleaned require a substantial amount of work to effect the necessary foam generation and produce a desired cleaning action.

In the case of upholstery fabric there is a tendency for foam to stay on the surface and not to penetrate through the fabric, and on the other hand, for such foam as may penetrate through the fabric to stay there and not come out from beneath the fabric.

Attempts have been made to reduce the work involved in carpet cleaning by employing a hard surface applicator roller and pre-foaming the detergent as or before its application to the roller, as in the Highswander U.S. Pat. No. 3,328,829. Actually, this did not reduce the work since in general the foam generation ahead of the roller involved greater work.

Various roller constructions have been proposed in the paint applicator field as illustrated in such patents as Guimond U.S. Pat. No. 2,538,241, Sprung, U.S. Pat. No. 2,652,774, and Calemartori, U.S. Pat. No. 3,448,479. These are in effect applying a viscous liquid to a generally hard surface and the roller constructions, therefore, are not applicable to applicant's purpose. The vacuum cup projections of the Guimond roller for instance depend upon employing a solid but yieldable rubber roller, and not a sponge. In general paint applicator rollers are not looked to for suggestions on the construction of fabric cleaner rollers.

SUMMARY OF THE INVENTION

The present invention utilizes a pre-formed foam detergent as from an aerosol can and readily transmits the foam to the fabric by a sponge roller having discrete spaced cavities in its face that operate on a push-pull principle to force the foam through the fabric and then suck the foam back through the fabric and out. In the disclosed embodiment, the cavities are uniformly arrayed in both axial and circumferential directions.

The cavities preferably embody radial holes in the sponge opening outwardly thereof and extending inwardly a substantial distance. The lands between the holes are generally thin and readily compressed and/or deformed in squeezing the foam from the holes as the roller progressively approaches successive areas of the surface to be cleaned.

On the backside of the roller the lands again expand the holes, thereby effecting a suction action which tends to draw the foam back out of the fabric.

By reason of the construction described the work necessary for manipulating the applicator to and fro in pressure contact with the fabric is at a minimum, and the substantial working of the sponge lands maintains the foam more readily and causes any foam in the pores of the lands to be more readily utilized by passing into the holes, and ultimately the workpiece, and thereafter to be withdrawn from the holes into the lands.

It is generally desirable to provide a skin covering the multiplicity of pores in at least part of the inner surfaces of the cavities. This may be accomplished by either burning the cavities in an otherwise fully cylindrical surface, or by spraying the surface by a suitable material.

A foam distributor channel is provided between the mouth of the aerosol can and the roller, and the cavities in the roller readily pick up the foam from the channel and carry it to the surface to be cleaned.

BRIEF DESCRIPTION OF THE DRAWINGS

The best mode presently contemplated by the applicant for carrying out the invention is illustrated in the accompanying drawings in which.

DESCRIPTION OF THE PREFERRED EMBODIMENT

Figure 1:
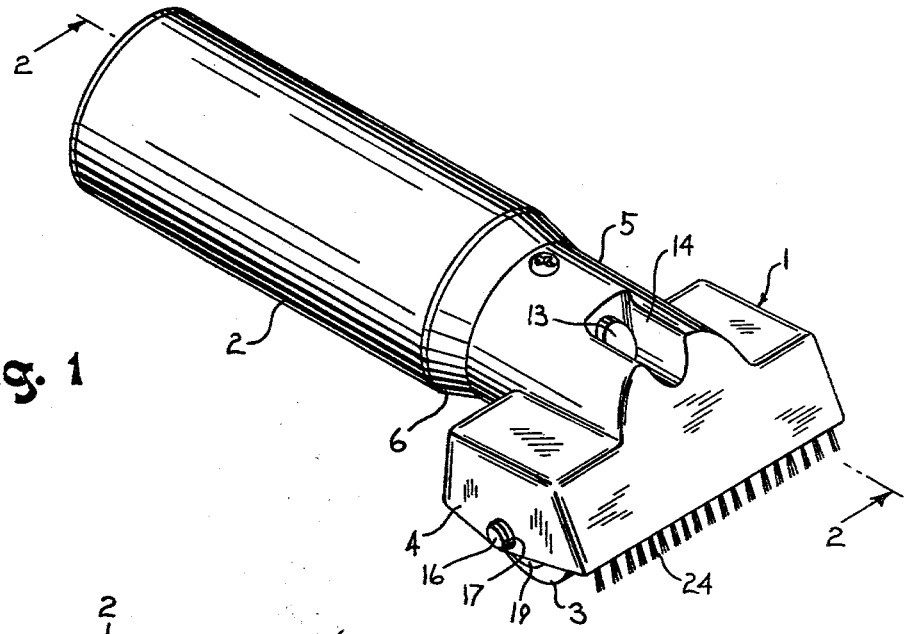
FIG. 1 is a perspective view of a hand operated fabric cleaner of the invention.
Figure 2:
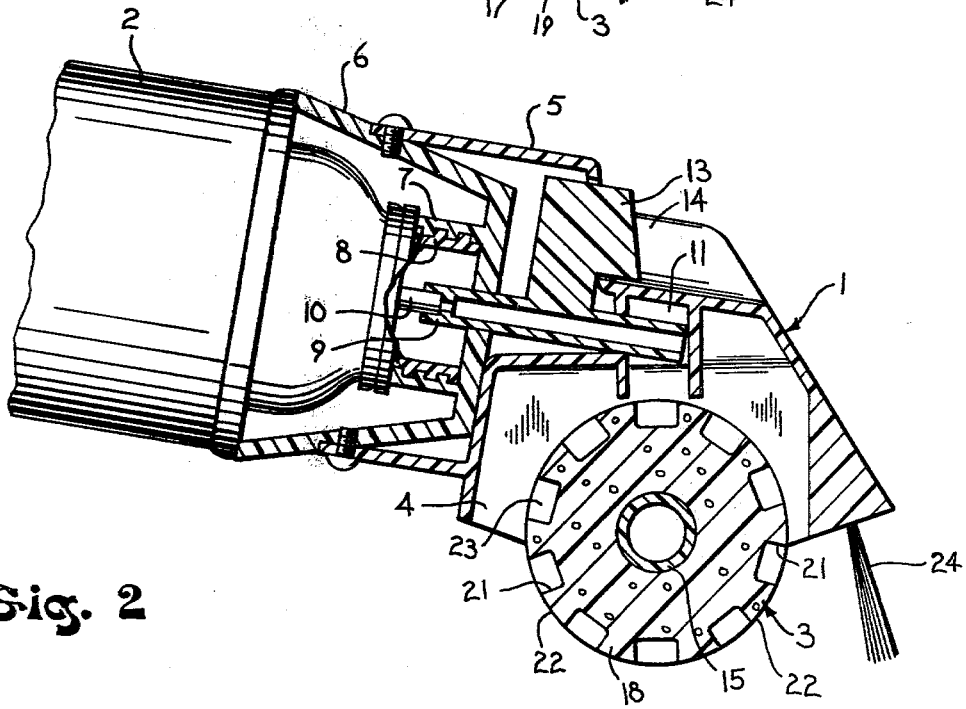
FIG. 2 is a central longitudinal section through the device of FIG. 1 with a portion of the aerosol can cut away.
Figure 3:
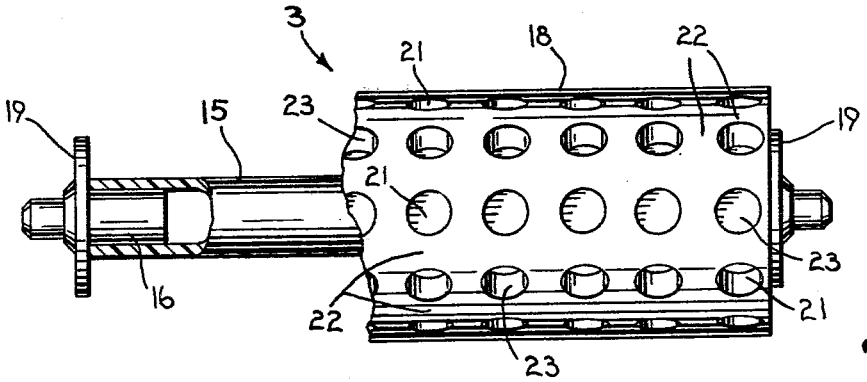
FIG. 3 is an elevation of the roller with parts broken away to illustrate the construction.

The cleaner illustrated comprises, in general, a housing 1 to which an aerosol cartridge can 2 constituting a handle is removably secured, and an applicator roller 3 carried by the housing.

The housing 1 is of downwardly facing open channular construction with closed ends 4 and a central semi-cylindrical raised portion 5 on top extending rearwardly to carry a connector cup 6 for receiving the head of the aerosol can 2.

The cup 6 has a threaded nipple 7 for removably securing a corresponding complementary nipple 8 of can 2.

A tubular valve push rod 9 extends axially of cup 6 with its inner end engaging the valve stem 10 of cartridge can 2 to actuate the normally closed valve in the cartridge 2 for discharge of detergent foam therefrom through the tubular push rod. For this purpose the aerosol cartridge can 2 contains a suitable detergent foaming material and propellant as is well known.

The tubular push rod 9 extends forwardly through nipple 7 and into a spreader channel 11 in housing 1 parallel to and above roller 3.

The channel 11 serves to receive foam 12 from the outer end of tubular push rod 9 and is open downwardly toward roller 3 to deliver foam thereon.

A finger actuated button 13 is preferably formed on the tubular push rod 9 and extends through the top of housing 1 and forwardly in a recess 14 which provides access thereto by a finger of the operator.

Pushing of the button 13 inwardly by a finger moves tubular push rod 9 inwardly to open the release valve, not shown, of the aerosol cartridge. Release of button 13 by the finger allows the cartridge valve to close as is customary with aerosol cartridges.

The roller 3 comprises a solid cylindrical core 15 carried by the stub axles 16 extending through bearing openings 17 in ends 4 of the housing 1.

A thick sleeve 18 of synthetic open cell multiple pore sponge material such as foamed polyurethane is mounted on core 15 and held in place by end washers 19.

The sleeve 18 of roller 3 is generally cylindrical and of uniform thickness sufficient to provide for substantial radial compression of the sleeve as it is pressed against a fabric surface 20 by the hand of an operator grasping the cartridge 2 which serves as a handle.

It has been found that a sponge roller of substantially uniform cylindrical contour as in the Yonkers U.S. Pat. No. 2,975,462, referred to above, does not readily pick up detergent foam 12 from channel 11 since the foam does not penetrate through the surface pores of the sponge into successive inner cells.

The present invention provides a plurality of discrete spaced cavities 21 extending preferably in the form of holes radially inwardly of sleeve 18 and opening outwardly of the surface of the sleeve. As shown in the present embodiment, cavities 21 are uniformly arrayed in both axial and circumferential directions, and are substantially uniformly spaced. The cavities are substantially wider and deeper than the individual open-cell pores of sleeve 18. Relatively narrow lands 22 which are about the width of cavities 21 extend between and separate the cavities. Each cavity 21 is thus surrounded by lands 22 which are readily deformed and compressed as the roller moves over and in rolling pressure contact with the fabric 20, as shown in FIGS. 4 and 5.

The cavities 21 generally fill with detergent foam 12 as they pass beneath channel 11 and carry the foam down to the fabric.

Figure 4:
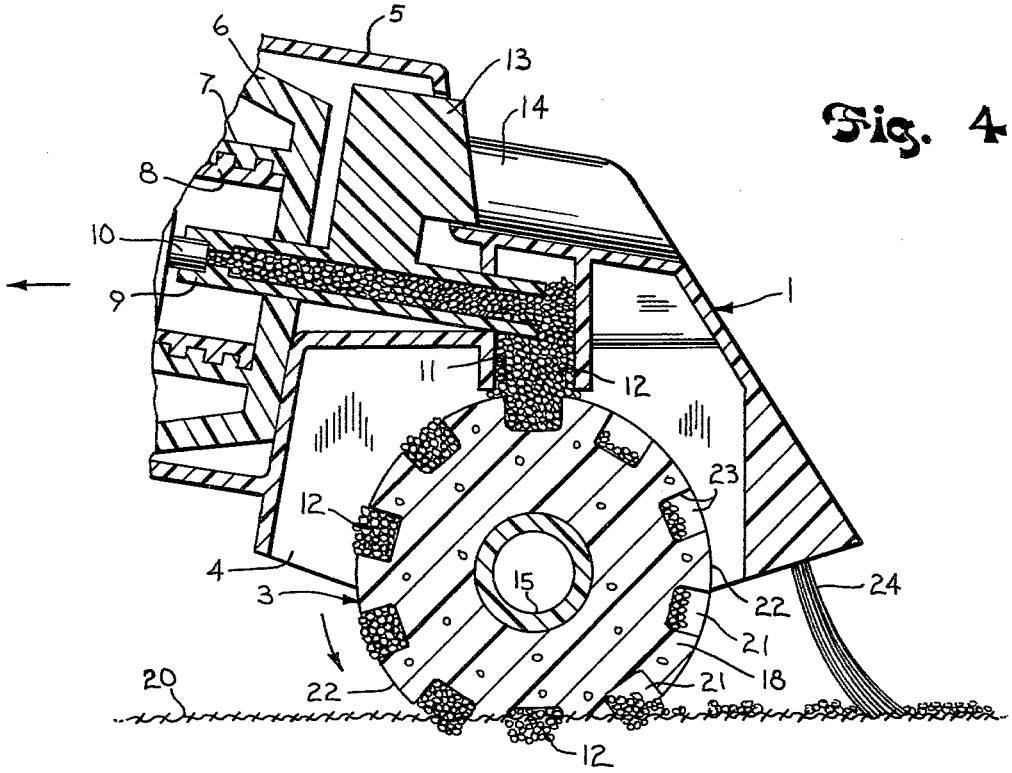
FIG. 4 is an enlarged showing of the front end of FIG. 2 in action on a fabric surface.
Figure 5:
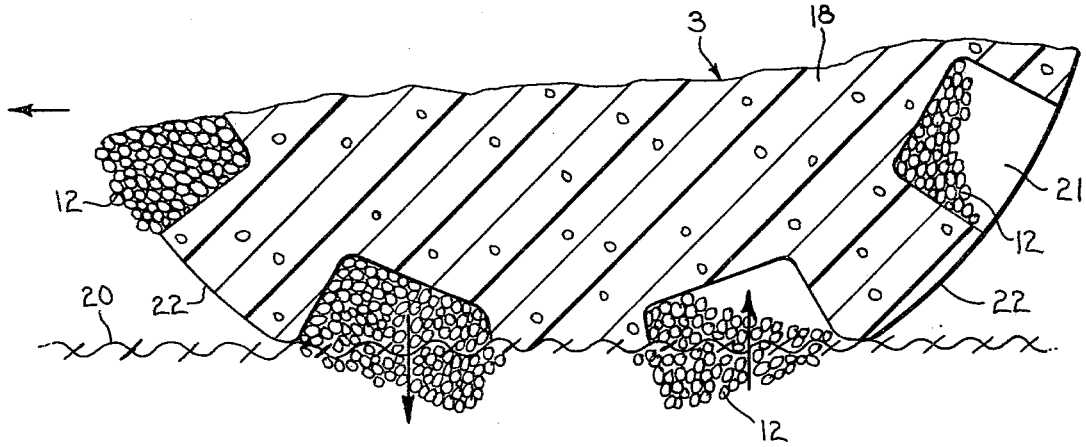
FIG. 5 is a much enlarged detail showing of the action of the roller in its push-pull of foam through the fabric.

As the foam filled cavities 21 approach the fabric 21 on the forward side of the roller 3 the surrounding lands 22 progressively deform and compress to squeeze the foam 12 from the cavities and force the same downwardly into and generally through the fabric 20 as illustrated in FIGS. 4 and 5.

Then, as the reduced cavities 21 start to expand on the back side of the roller 3 they begin to suck the foam 12 back up through the fabric 20 and into the cavities for repeated use.

The net result is that the cavities become working chambers providing a vertical push-pull action of the foam going down through the fabric and then back up through and out.

Insofar as some foam is retained by the fabric, the cavities on the back side of the roller are generally not filled with foam until they pass under channel 11 where they receive a fresh charge of foam which mixes with the previous charge of foam to again repeat the push-pull action through the fabric in a succeeding area.

Continued successive working of the lands surrounding the discrete cavities will ultimately fill the pores or cells of the sponge with detergent foam which adds to the foam available for the push-pull action.

However, it is preferable to provide a skin 23 generally lining the cavities 21 and at least partially closing the multiplicity of pores of the cavities, so that a more effective push-pull action is obtained. Lands 22 remain unskinned.

The skin 23 may be provided in different ways. One way is to use a hot tool in forming the cavities and which tends to melt the sponge material and at least partially close the pores therein. Another way is to spray a skin forming substance such as a liquid containing a synthetic rubber base and a suitable solvent.

For the purpose of aiding in the wetting of the surface of the fabric with the foam, a single row of brush bristles 24 is carried by either or both depending edges of the housing 1, and which tends to horizontally spread the foam retained on the fabric in reciprocal action of the applicator.

In cleaning fabrics having a substantial nap on the surface as in the case of some upholstery and rugs, the cavities 21 receive portions of the nap and tend to generate foam, thus making it possible to apply a liquid detergent to the top of the roller as was the case in the Yonkers U.S. Pat. No. 2,975,462, referred to above.

While the primary purpose of the invention is to provide a cleaner for upholstery fabrics, the cleaner will be adapted to cleaning rugs, carpets and other fabrics with the same general facility.

Various modes of carrying out the invention are contemplated as being within the scope of the following claims particularly pointing out and distinctly claiming the subject matter which is regarded as the invention.

We claim:

1. A cleaner for fabrics such as upholstery and the like, comprising:

(a) a core and a sleeve thereon which together form a roller, (b) said sleeve being of synthetic open cell multiple pore sponge material, (c) a plurality of discrete cavities disposed in the outer surface of the said roller sleeve and with said cavities opening outwardly of the sleeve surface and extending radially inwardly thereof, (d) said cavities each including a skinned surface substantially covering the pores of said sponge material within said cavities and wherein each of said cavities is wider and deeper than the individual pores of said roller sleeve and wherein said cavities are spaced apart to form unskinned lands therebetween, and further wherein said cavities comprise means to force foam detergent onto the fabric in an application and removal action on discrete surface areas of the fabric as the roller progresses thereover, (e) means mounting said roller for reciprocal movement over and in rolling pressure contact with a fabric to be cleaned, (f) and means to supply a detergent foam to the top of said roller to successively fill the said cavities with said foam during said reciprocal movement.

2. The cleaner of claim 1 in which said cavities are uniformly arrayed axially and circumferentially on said roller sleeve.

* * * * *